US007630673B2

(12) United States Patent
Michishita

(10) Patent No.: US 7,630,673 B2
(45) Date of Patent: Dec. 8, 2009

(54) IMAGE FORMING APPARATUS WITH A GUIDE HAVING A RIGID FIRST MEMBER WITH A CUTOUT AT A DOWNSTREAM END AND AN ELASTIC SECOND MEMBER COVERING THE CUTOUT AND FACING A TRANSFER SHEET

(75) Inventor: Yasuhiro Michishita, Osaka (JP)

(73) Assignee: Kyocera Mita Corporation (JP)

( * ) Notice: Subject to any disclaimer, the term of this patent is extended or adjusted under 35 U.S.C. 154(b) by 117 days.

(21) Appl. No.: 11/897,139

(22) Filed: Aug. 29, 2007

(65) Prior Publication Data

US 2008/0056781 A1 Mar. 6, 2008

(30) Foreign Application Priority Data

Aug. 31, 2006 (JP) ..... 2006-235057

(51) Int. Cl.
*G03G 15/16* (2006.01)
*G03G 15/00* (2006.01)

(52) U.S. Cl. ..... 399/316

(58) Field of Classification Search ..... 399/316, 399/388, 389
See application file for complete search history.

(56) References Cited

U.S. PATENT DOCUMENTS 4,933,723 A * 6/1990 Kakuta et al. ..... 399/316
5,594,539 A * 1/1997 Murano et al. ..... 399/316
2002/0064405 A1 5/2002 Tomiki et al.
2003/0086733 A1* 5/2003 Sawai et al. ..... 399/316 X
2005/0069343 A1* 3/2005 Deguchi et al. ..... 399/111

FOREIGN PATENT DOCUMENTS

| | | | |
|---|---|---|---|
| CN | 1351282 | | 5/2002 |
| JP | 58-137864 A | * | 8/1983 |
| JP | 60-043671 A | * | 3/1985 |
| JP | 62-141585 A | * | 6/1987 |
| JP | 05-257395 A | * | 10/1993 |
| JP | 2001-117375 | | 4/2001 |
| JP | 2004-115266 | | 4/2004 |

* cited by examiner

*Primary Examiner*—Sophia S Chen
(74) *Attorney, Agent, or Firm*—Gerald E. Hespos; Anthony J. Casella

(57) ABSTRACT

An image forming apparatus has an image bearing member. A transfer member forms a nip with the image bearing member and transfers a toner image to a surface of a transfer sheet guided to the nip. A guide is immediately upstream of the nip in a sheet conveying direction. The guide is in sliding contact with one side of the transfer sheet and guides the transfer sheet to the nip. The guide includes a rigid member having a flat surface along the sheet conveying direction. A cutout is formed in the flat surface of the rigid member. The guide also has a flat elastic member placed on the flat surface of the rigid member to cover the cutout and to be held in sliding contact with the transfer sheet.

20 Claims, 7 Drawing Sheets

FIG.6

| | | THICKNESS (μm) | AMOUNT OF ACTUAL DISPLACEMENT (mm) | ELASTIC FORCE (gf/mm$^2$) |
|---|---|---|---|---|
| TRANSFER SHEET | 80 g/m$^2$ | 80 | 32.5 | 0.0010 |
| | 120 g/m$^2$ | 140 | 21.0 | 0.0016 |
| | 157 g/m$^2$ | 200 | 6.5 | 0.0051 |
| | 187g/m$^2$ (POSTAL CARD) | 225 | 2.5 | 0.0133 |
| | 209 g/m$^2$ | 255 | 2.0 | 0.0167 |
| HIGH-MOLECULAR POLYETHYLENE SHEET (SECOND MEMBER) | | 130 | 34.0 | 0.0010 |
| | | 280 | 16.0 | 0.0021 |
| | | 330 | 10.5 | 0.0032 |
| | | 360 | 6.7 | 0.0050 |
| | | 410 | 2.0 | 0.0167 |
| | | 430 | 1.5 | 0.0222 |

FIG.7

| | SHEET THICKNESS [μm] | FREE LENGTH [mm] | 80g/m² | | 157g/m² | | 187g/m² | | 209g/m² | | JUDGMENT |
|---|---|---|---|---|---|---|---|---|---|---|---|
| | | | TRANSFER DEFECTS | HOLLOW DEFECTS | TRANSFER DEFECTS | HOLLOW DEFECTS | TRANSFER DEFECTS | HOLLOW DEFECTS | TRANSFER DEFECTS | HOLLOW DEFECTS | |
| ONLY FIRST MEMBER | – | – | ○ | ○ | ○ | ○ | ○ | × | ○ | × | NG |
| FIRST MEMBER + SECOND MEMBER | 130 | 2 | △ | ○ | ○ | ○ | ○ | × | ○ | × | NG |
| | 130 | 3 | × | ○ | ○ | ○ | ○ | × | ○ | × | NG |
| | 130 | 4 | × | ○ | ○ | ○ | ○ | ○ | ○ | ○ | NG |
| | 130 | 5 | × | ○ | ○ | ○ | ○ | ○ | ○ | ○ | NG |
| | 280 | 4 | △ | ○ | ○ | ○ | ○ | ○ | ○ | ○ | OK |
| | 330 | 4 | △ | ○ | ○ | ○ | ○ | ○ | ○ | ○ | OK |
| | 360 | 4 | ○ | ○ | ○ | ○ | ○ | ○ | ○ | ○ | OK |
| | 380 | 4 | ○ | ○ | ○ | ○ | ○ | ○ | ○ | ○ | OK |
| | 410 | 4 | ○ | ○ | ○ | ○ | ○ | △ | ○ | △ | OK |
| | 480 | 4 | ○ | ○ | ○ | ○ | ○ | × | ○ | × | NG |

IMAGE FORMING APPARATUS WITH A GUIDE HAVING A RIGID FIRST MEMBER WITH A CUTOUT AT A DOWNSTREAM END AND AN ELASTIC SECOND MEMBER COVERING THE CUTOUT AND FACING A TRANSFER SHEET

BACKGROUND OF THE INVENTION

1. Field of the Invention

The present invention relates to an electrophotographic image forming apparatus.

2. Description of the Related Art

Conventionally, in electrophotographic image forming apparatuses such as copiers, printers, facsimile machines and complex machines of these, a toner image formed on an image bearing member such as a photoconductive drum having a photoconductive layer on the outer surface thereof is generally transferred to a surface of a transfer sheet.

In a general electrophotographic image forming apparatus, a charging process of uniformly charging the outer surface of the photoconductive drum, an exposing process for irradiating the charged outer surface of the photoconductive drum with a laser beam to form an electrostatic latent image, a developing process for attaching toner particles to the electrostatic latent image to form a toner image, a transferring process for transferring the toner image to a surface of a transfer sheet, a fixing process for fixing the toner image on the surface of the transfer sheet to the surface of the transfer sheet and a cleaning process for removing the toner residual on the outer surface of the photoconductive drum in the transferring process are repeated.

In the above transferring process, a bias transfer method using a transfer roller as a transfer member arranged to face the photoconductive drum is widely known. In this method, a nip portion is formed by pressing the transfer roller into contact with the photoconductive drum. The transfer roller applies a bias voltage to the transfer sheet from the rear side of the transfer sheet when the transfer sheet passes the nip portion. By giving transfer charges to the transfer sheet, the toner on the photoconductive drum is transferred to the transfer sheet.

At this time, an amount of electric charges necessary for the toner transfer is constant. Thus, in an image forming apparatus having a fast processing speed, transfer charges need to be given within a shorter period of time, wherefore a transfer roller needs to apply a higher transfer bias voltage.

On the other hand, in a pre-nip area upstream of the nip portion in a conveying direction, an electric field is generated between the transfer roller and the photoconductive drum by the bias voltage applied to the transfer roller. Accordingly, if a high-voltage transfer bias is applied, the intensity of the electric field generated in the pre-nip area becomes higher. Under such a high electric field, discharge occurs according to Paschen's law if the intensity of the electric field in a gap exceeds a discharge starting point.

Further, if discharge occurs between the transfer sheet and the photoconductive drum, electric charges having a polarity opposite to the charging polarity of the toner particles are given to the toner particles in the pre-nip area, whereby a charge amount distribution of the toner particles largely shifts toward the opposite polarity side. Such toner particles having the opposite polarity is unlikely to be transferred to the transfer sheet, and there has been a problem of occurrence of so-called hollow defects (white spots) phenomenon in which a part where discharge has occurred become white in the toner image transferred to the surface of the transfer sheet.

In view of this, it is thought to dispose a guide member for guiding the transfer sheet to the nip portion at a position immediately upstream of the nip portion in the conveying direction.

Concerning such a guide member, Japanese Unexamined Patent Publication No. 2004-115266 (D1) discloses the use of a pair of guide members located at the upper and lower sides of a conveyance path for a transfer sheet and inclined toward each other such that spacing therebetween becomes gradually narrower toward a downstream side in the conveying direction. The document D1 also discloses that the guide member located above the conveyance path out of the pair of guide members is formed with a cutout having less interference (sliding contact) during the passage of a postal card (thick sheet) or the like in order to soften a shock caused by the collision of the postal card with the nip portion.

Further, Japanese Unexamined Patent Publication No. 2001-117375 (D2) discloses that an elastic guide member is disposed below a conveyance path for a transfer sheet and the leading end of the guide member is located closer to a photoconductive drum than a tangent at a transfer nip. This construction is proposed to prevent hollow defects caused by discharge in a pre-nip area.

However, if the guide member located above the conveyance path is formed with the cutout as disclosed in the document D1, the influence of the guide member located below the conveyance path becomes stronger when the transfer sheet enters the nip portion. Thus, a sufficient effect of preventing hollow defects resulting from the occurrence of discharge in the pre-nip area cannot be expected.

Further, in the construction as disclosed in the document D2, a force of conveying the transfer sheet becomes weaker in the vicinity of a widthwise middle part of the transfer sheet due to the deflection of the transfer roller along the longitudinal direction of the transfer roller (width direction of the transfer sheet). Thus, a conveying speed is slower for narrow transfer sheets than for recording media having a maximum width. In addition, in the case of using a thick postal card or the like as the transfer sheet, a conveyance load of the guide member is larger than in the case of a PPC sheet as the transfer sheet, wherefore there is a problem of further slowing down the conveying speed.

SUMMARY OF THE INVENTION

An object of the present invention is to prevent hollow defects on a surface of a transfer sheet, to prevent hollow defects and a reduction in a conveying speed for postal cards and like thick sheets.

In order to accomplish the above object, one aspect of the present invention is directed to an image forming apparatus, comprising an image bearing member for bearing a toner image; a transfer member arranged to face the image bearing member to form a nip portion together with the image bearing member, and adapted to transfer the toner image to a surface of a transfer sheet guided to the nip portion; a guide member arranged immediately upstream of the nip portion in a sheet conveying direction so as to guide the transfer sheet to the nip portion and to be held in sliding contact with one side of the transfer sheet, wherein the guide member includes a first member made of a rigid member, having a flat surface along the sheet conveying direction and having a cutout with a specified width along a sheet width direction normal to the sheet conveying direction formed in the flat surface at a leading end portion located at a downstream side in the sheet conveying direction, and a second member made of an elastic flat member and placed on the flat surface of the first member so as to cover the cutout and to be held in sliding contact with the one side of the transfer sheet.

BRIEF DESCRIPTION OF THE DRAWINGS

FIG. 6 is a table showing a relationship between second members made of elastic flat members and elastic forces of transfer sheets.

FIG. 7 is a table showing judgment results on the adaptability of second members made of elastic flat members in an actual machine.

DETAILED DESCRIPTION OF THE PREFERRED EMBODIMENTS

Next, an image forming apparatus according to one embodiment of the present invention is described with reference to the accompanying drawings.

Figure 1:
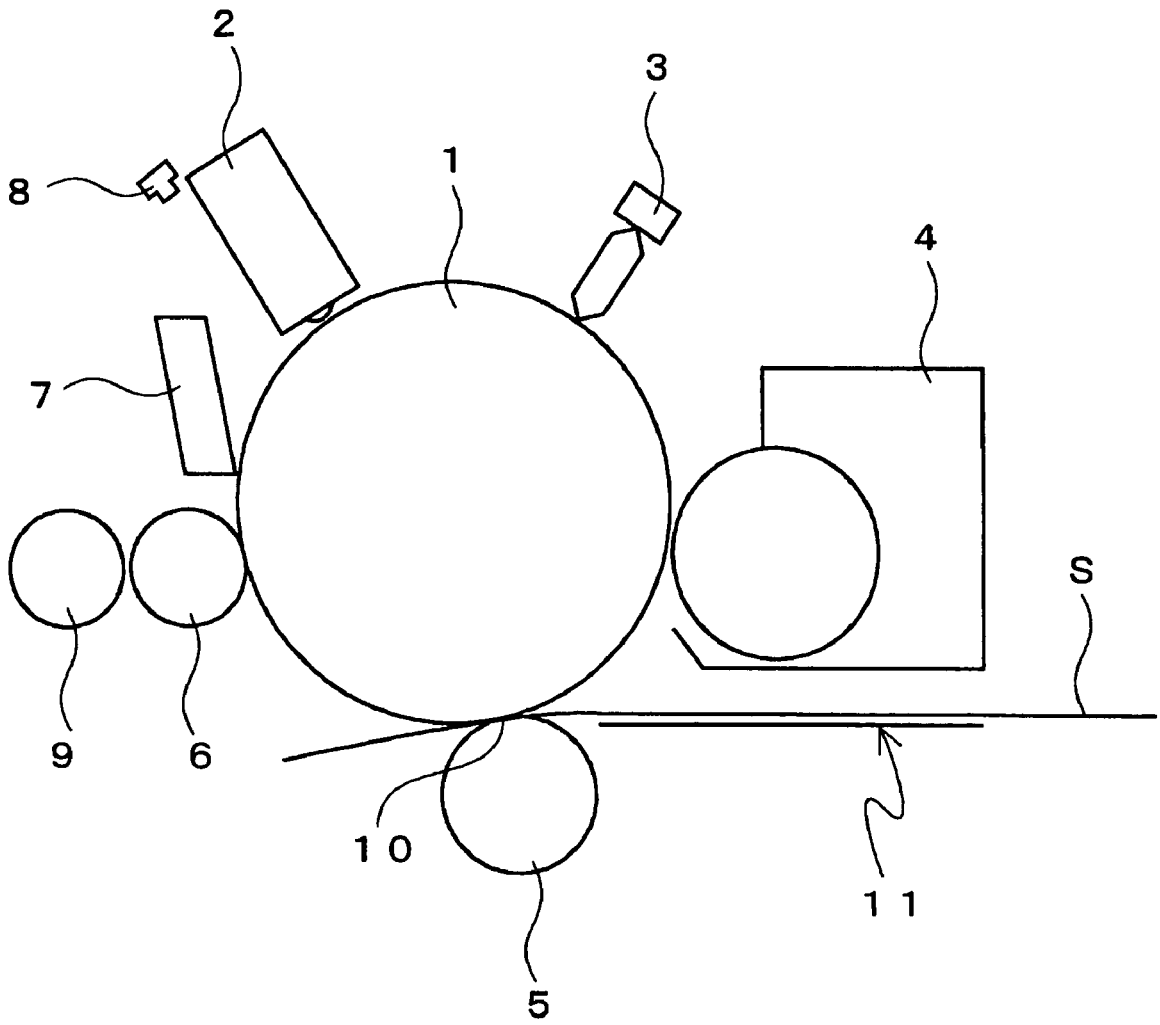
FIG. 1 is a diagram showing an essential portion of an image forming apparatus according to one embodiment of the invention.
Figure 2:
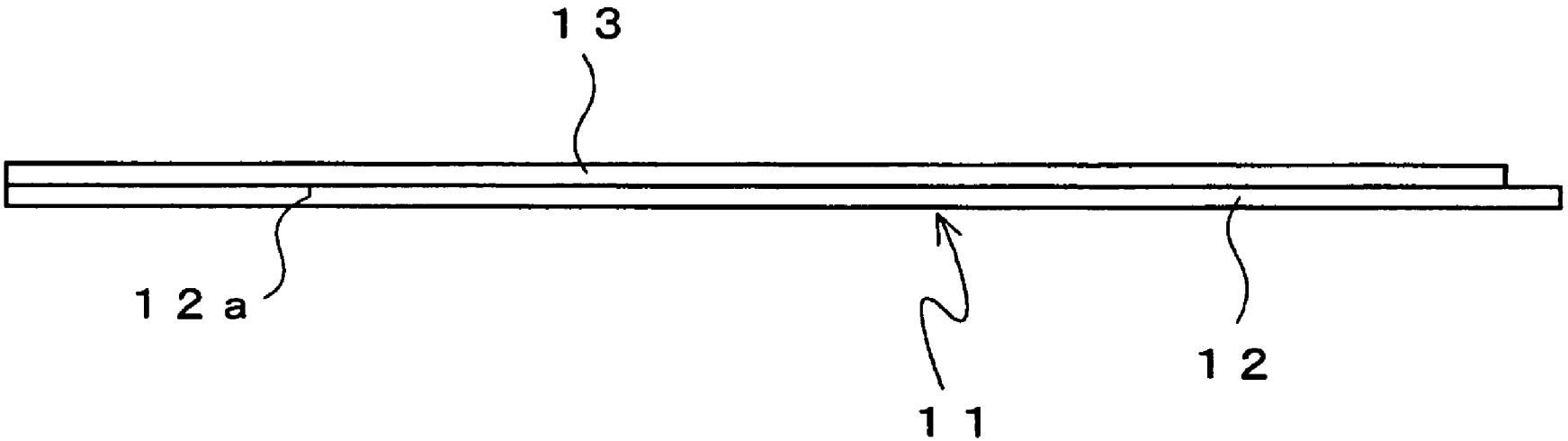
FIG. 2 is a side view of a guide member of the image forming apparatus.
Figure 3:
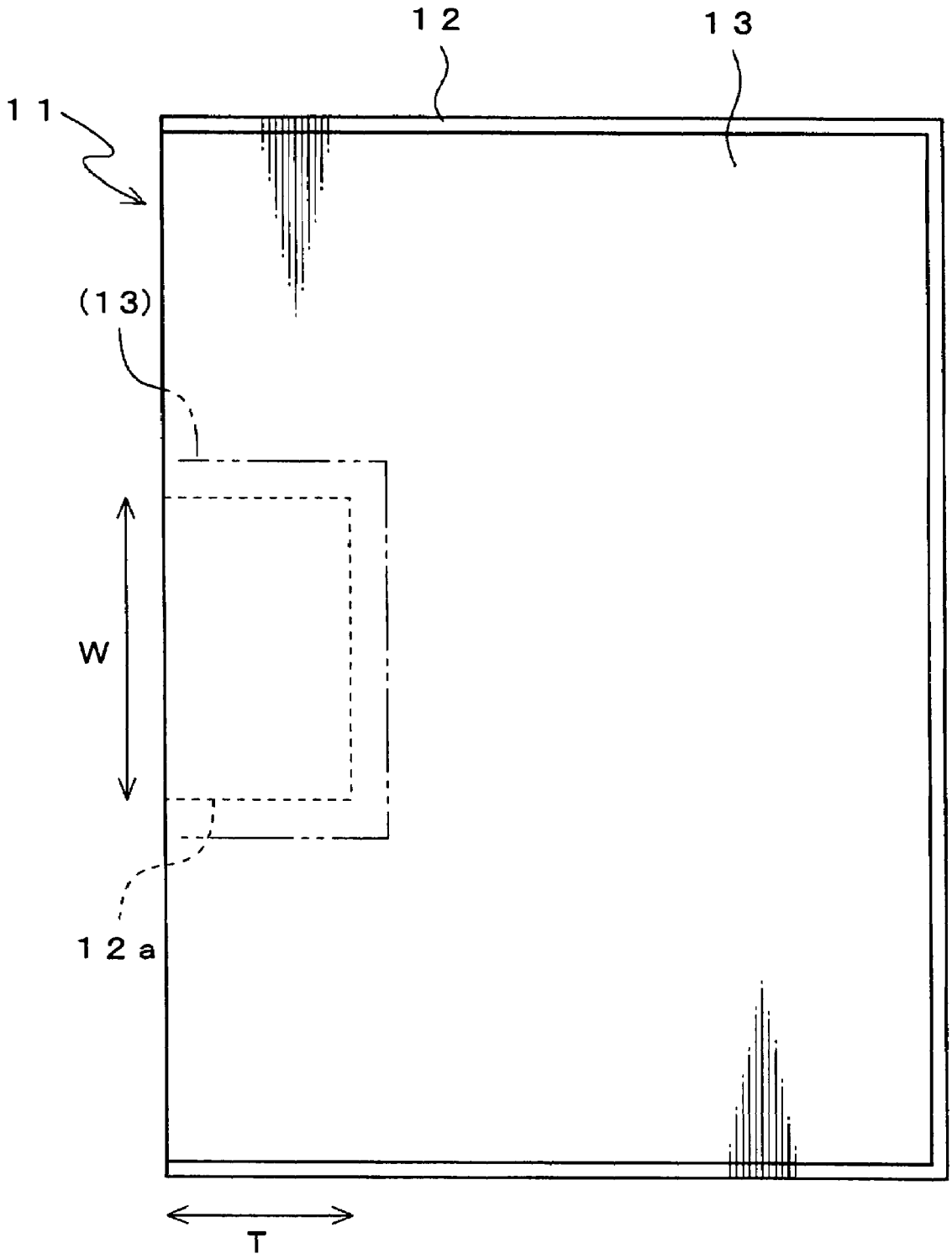
FIG. 3 is a plan view of the guide member of the image forming apparatus.
Figure 4:
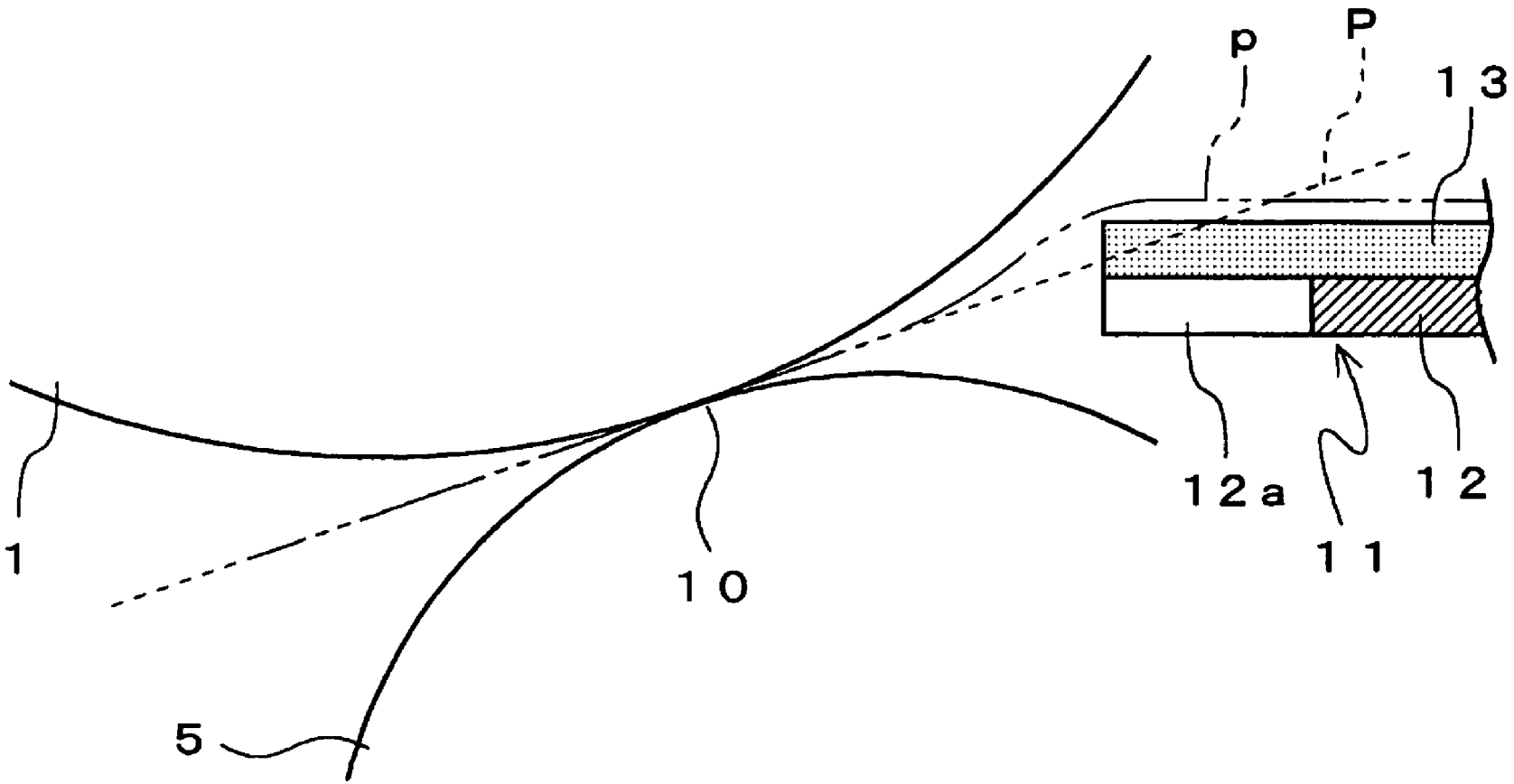
FIG. 4 is a section showing an essential portion of the image forming apparatus.

FIG. 1 is a diagram showing an essential portion of the image forming apparatus according to one embodiment of the invention, FIG. 2 is a side view of a guide member of the image forming apparatus, FIG. 3 is a plan view of the guide member of the image forming apparatus, and FIG. 4 is a section showing an essential portion of the image forming apparatus.

As shown in FIG. 1, the image forming apparatus includes a photoconductive drum 1 as an image bearing member having a photoconductive layer on the outer surface thereof. A charger 2, an exposing device 3, a developing device 4, a transfer roller 5 as a transfer member, a sliding-contact member (roller) 6, a cleaning blade 7 and a charge remover 8 such as an LED are arranged around the photoconductive drum 1 in this order in a rotating direction of the photoconductive drum 1. Identified by S in FIG. 1 is a transfer sheet (recording sheet). A heating element 9 including a rod heater or surface heater is held in contact with the sliding-contact member 6.

The photoconductive drum 1 and transfer roller 5 face each other and are pressed in contact, thereby forming a nip portion 10. A guide member 11 for guiding the transfer sheet S to the nip portion 10 is disposed immediately upstream of the nip portion 10 in a conveying direction of the transfer sheet S.

The photoconductive drum 1 is for bearing an electrostatic latent image formed on the outer surface thereof. An amorphous silicon photoconductive drum may be, for example, used as the photoconductive drum 1. This photoconductive drum is constructed such that a carrier injection inhibition layer made of Si:H:B:O or the like, a carrier excitation/transport layer (photoconductive layer) made of Si:H or the like, and a surface protection layer made of SiC:H or the like are successively laminated on a conductive substrate.

The charger 2 is disposed above the photoconductive drum 1 for uniformly charging the photoconductive drum 1.

The exposing device 3 is for forming an electrostatic latent image on the photoconductive drum 1, for example, based on an image data of a document read by an unillustrated image data input unit or an image data outputted from a personal computer or the like.

The developing device 4 is for forming a toner image by supplying a developer to the outer surface of the photoconductive drum 1 formed with the electrostatic latent image. It should be noted that the developer used in this embodiment contains toner particles and magnetic powder and abrasive fine particles are fixed to the outer surfaces of the toner particles. Fine particles having high hardness such as metal oxides of alumina, zirconia and titania are suitable as the abrasive fine particles. In addition to the abrasive fine particles, fine powder of silica or the like may be added to regulate fluidity and charging property.

The transfer roller 5 is a roller member for transferring the toner image on the photoconductive drum 1 to the transfer sheet S. The transfer roller 5 applies a bias voltage to the transfer sheet S from the rear side of the transfer sheet S when the transfer sheet S passes the nip portion 10. By giving transfer charges to the transfer sheet S, the toner image on the photoconductive drum 1 is transferred to the transfer sheet S.

The sliding-contact member 6 is rotatably disposed to face the photoconductive drum 1 and comes into contact with the outer surface of the photoconductive drum 1 to abrade off ion products formed on the outer surface of the photoconductive drum 1 in an image forming process. Here, the sliding-contact member 6 is biased toward the photoconductive drum 1 by an unillustrated spring. The developer contains titanium oxide or the like as an abrasive agent as described above, and the outer surface of the photoconductive drum 1 is abraded by this titanium oxide when the sliding-contact member 6 comes into contact with the outer surface of the photoconductive drum 1.

The cleaning blade 7 is disposed above the sliding-contact member 6 for cleaning the residual toner particles on the outer surface of the photoconductive drum 1 by being held in sliding contact with the photoconductive drum 1. The cleaning blade 7 is made of urethane rubber or the like and is pressed in contact with the photoconductive drum 1. The residual toner particles scraped off by the cleaning blade 7 are collected by a toner collecting screw (not shown).

As shown in FIGS. 2 and 3, the guide member 11 is such that a first member 12, which is a rigid flat member, and a second member 13, which is an elastic flat member, are placed one over another.

The first member 12 is formed at the leading edge located at a downstream side in a sheet conveying direction with a cutout 12*a* having a specified width W along a sheet width direction normal to the sheet conveying direction. It is sufficient for the first member 12 to have a flat surface along the sheet conveying direction, and it is not always necessary to use a flat member.

The second member 13 is attached to the front surface of the first member 12 so as to cover the cutout 12*a* and come into sliding contact with one side (rear side) of the transfer sheet S.

As shown in FIG. 4, the leading end of the first member 12 is located closer to the transfer roller 5 than a tangent P at the nip portion 10. Contrary to this, the leading end of the second member 13 is located closer to the photoconductive drum 1 than the tangent P. Thus, the transfer sheet S is conveyed along such a path "p" as to enter the nip portion 10 from a side closer to the photoconductive drum 1 than the tangent P.

The first member 12 can be made of a material having a high shape retaining property such as a hard resin or metal. Further, in the case of considering the conveyance of a postal card as the transfer sheet S, the width of the cutout 12*a* in the sheet width direction may be set to be slightly wider (for example, 106 mm) than the width of the postal card normal to the conveying direction of the postal card.

The second member 13 is preferably made of a conductive material. This can prevent the friction charging of the guide member 11 resulting from the sliding contact of the transfer sheet being conveyed with the second member 13, thereby preventing the guide member 11 from being smeared by the scattered toner particles. Further, the second member 13 is preferably made of a material having an abrasion resistance and a low coefficient of friction (0.15 or lower). This can ensure a sufficient resistance against the sliding contact of the transfer sheet S and reduce a frictional force during the sliding contact of the transfer sheet S. The second member 13 preferably has a specified elastic force selected from a range from 0.002 gf/mm$^2$ (inclusive) to 0.02 gf/mm$^2$ (inclusive).

Figure 5:
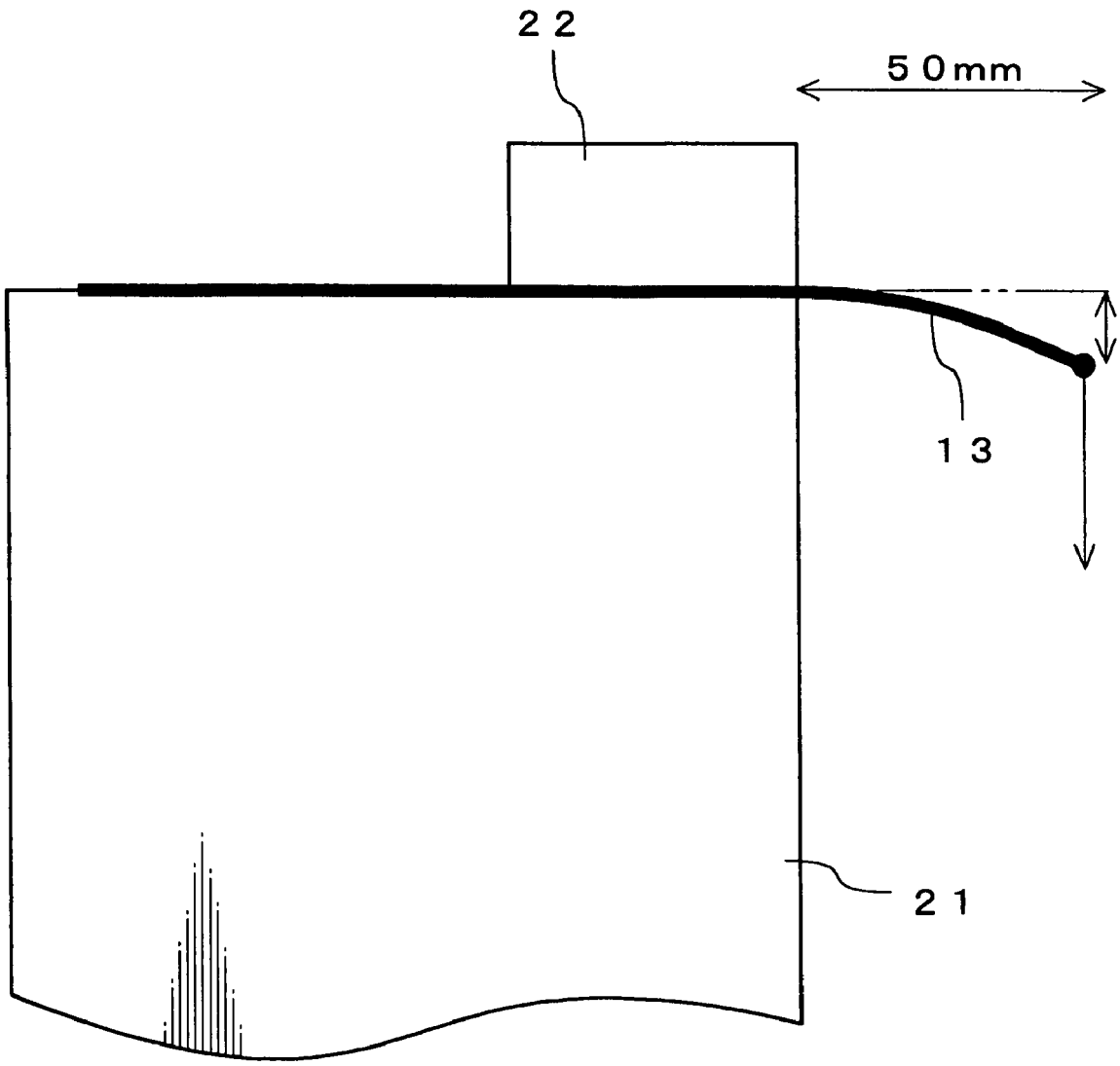
FIG. 5 is a diagram showing an experimental example showing grounds for an elastic force.

FIG. 5 is a diagram showing an experimental example showing grounds for the above elastic force, FIG. 6 is a table showing a relationship between second members 13 and elastic forces of transfer sheets S, and FIG. 7 is a table showing judgment results on the adaptability of the respective second members 13 in an actual machine.

In FIG. 5, an experiment was conducted using high-molecular polyethylene sheets as one embodiment of the second member 13. The second members 13 made of high-molecular polyethylene sheets are placed on a base 21 and pressed by a retainer 22, and leading end portions thereof are caused to overhang. Projecting amounts (free lengths) were 50 mm. After hanging amounts of the leading end portions due to their own weights were measured, amounts of displacement were measured in the case where a load of 1 Kg was applied to the leading end portions. Numerical values obtained by load (1 Kg)÷(amount of actual displacement×sample width) using numerical values obtained by subtracting the hanging amounts from the amounts of displacement as actual amounts of displacement are written as elastic force in FIG. 6.

Sheet thickness, free length, and transfer defects in FIG. 7 are respectively the thickness of the second member 13, the depth T (see FIG. 3) of the cutout 12*a*, and phenomenon in which the entire sheet surface becomes white due to excessive transfer charges. As shown in FIG. 7, good print results free from transfer defects and white spots could be obtained if the sheet thickness is 280 μm to 410 μm (elastic forces of 0.002 gf/mm$^2$ to 0.02 gf/mm$^2$).

As described above, the image forming apparatus of this embodiment is constructed such that the cutout 12*a* having the width W larger than the width of postal cards and the depth T is formed in the middle part of the rigid first member 12 and is covered by the second member 13 having a specified elasticity. By this construction, a conveyance load can be reduced utilizing the elastic force of the second member 13 upon guiding postal cards as thick sheets to the nip portion 10, whereby the conveyance speed of the transfer sheet S can be maintained while being unlikely to cause the formation of abnormal images such as those with hollow defects.

Not only by forming the cutout 12*a*, but also by covering the cutout 12*a* with the second member 13, the formation of abnormal images (transfer defects and white spots) caused by abnormal discharge of a transfer voltage can be prevented on the transfer sheets S of normal sizes wider than the width W of the cutout 12*a* and thick sheets narrower than the width W of the cutout 12*a*.

Although the second member 13 preferably has substantially the same size as the first member 12 as shown in solid line in FIG. 3, it may have a slightly larger size than the cutout 12*a* as shown in chain double-dashed line in FIG. 3.

The specific embodiment described above mainly embraces inventions having the following constructions.

An image forming apparatus according to one aspect of the present invention comprises an image bearing member for bearing a toner image; a transfer member arranged to face the image bearing member to form a nip portion together with the image bearing member, and adapted to transfer the toner image to a surface of a transfer sheet guided to the nip portion; a guide member arranged immediately upstream of the nip portion in a sheet conveying direction so as to guide the transfer sheet to the nip portion and to be held in sliding contact with one side of the transfer sheet, wherein the guide member includes a first member made of a rigid member, having a flat surface along the sheet conveying direction and having a cutout with a specified width along a sheet width direction normal to the sheet conveying direction formed in the flat surface at a leading end portion located at a downstream side in the sheet conveying direction, and a second member made of an elastic flat member and placed on the flat surface of the first member so as to cover the cutout and to be held in sliding contact with the one side of the transfer sheet.

According to this construction, when a thick transfer sheet of a size corresponding to that of the cutout is guided to the nip portion, the rigid first member is not present by the presence of the cutout and the transfer sheet can be conveyed to the nip portion while being held in sliding contact only with the elastic second member. Therefore, hollow defects and a reduction in conveying speed can be prevented for thick postal cards and the like.

In the above construction, if the first member is also a flat member, the guide member can have a simple structure. In this case, the first member is preferably made of a hard metal or a material having a high shape retaining property such as a metal.

In this construction, when a postal card is conveyed as the transfer sheet, the width of the cutout in the sheet width direction is preferably slightly wider than the width of the postal card normal to a conveying direction of the postal card. According to this construction, a conveyance load can be normally reduced utilizing the elastic force of the second member when a postal card as a thick sheet is guided to the nip portion.

In this construction, it is preferable that the leading end of the first member is located closer to the transfer member than a tangent at the nip portion and that of the second member is located closer to the image bearing member than the tangent. Thus, the transfer sheet is conveyed along such a path as to enter the nip portion from a side closer to the image bearing member than the tangent at the nip portion. Therefore, in consideration of the elastic deformation of the second member, the transfer sheet can be better brought to the nip portion.

In this construction, the second member is preferably made of a conductive material.

According to this construction, the guide member can be prevented from being smeared by the scattered toner particles by preventing the friction charging of the guide member caused by the sliding contact of the transfer sheet being conveyed with the second member.

The second member preferably has an elastic force selected from a range from 0.002 gf/mm$^2$ (inclusive) to 0.02 gf/mm$^2$ (inclusive). This enables good print results free from transfer defects and white spots to be obtained.

Further, the second member is preferably made of material having an abrasion resistance and/or a low coefficient of friction. This can ensure resistance against the sliding contact of the transfer sheet and reduce a frictional force during the sliding contact of the transfer sheet.

A high-molecular polyethylene sheet can be suitably used as the second member.

This application is based on patent application No. 2006-235057 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus, comprising:

an image bearing member for bearing a toner image;

a transfer member arranged to face the image bearing member to form a nip portion together with the image bearing member, and adapted to transfer the toner image to a surface of a transfer sheet guided to the nip portion;

a guide member arranged immediately upstream of the nip portion in a sheet conveying direction so as to guide the transfer sheet to the nip portion and to be held in sliding contact with one side of the transfer sheet, wherein the guide member includes:

a first member made of a rigid member, having a flat surface along the sheet conveying direction and having a cutout with a specified width along a sheet width direction normal to the sheet conveying direction formed in the flat surface at a leading end portion located at a downstream side in the sheet conveying direction, and a second member made of an elastic flat member and placed on the flat surface of the first member so as to cover the cutout and to be held in sliding contact with the one side of the transfer sheet, and wherein the leading end of the first member is located closer to the transfer member than a tangent at the nip portion and that of the second member is located closer to the image bearing member than the tangent.

2. An image forming apparatus according to claim 1, wherein the first member is a flat member.

3. An image forming apparatus according to claim 2, wherein the first member is made of a hard resin or metal having a high shape retaining property.

4. An image forming apparatus according to claim 1, wherein, when a postal card is conveyed as the transfer sheet, the width of the cutout in the sheet width direction is slightly wider than the width of the postal card normal to a conveying direction of the postal card.

5. An image forming apparatus according to claim 1, wherein the second member is made of a conductive material.

6. An image forming apparatus according to claim 1, wherein the second member has an elastic force selected from a range from 0.002 gf/mm$^2$ (inclusive) to 0.02 gf/mm$^2$ (inclusive).

7. An image forming apparatus according to claim 1, wherein the second member is made of an abrasion resistant material.

8. An image forming apparatus according to claim 1, wherein the second member is made of a material having a low coefficient of friction.

9. An image forming apparatus according to claim 1, wherein the second member is made of a material having an abrasion resistance and a low coefficient of friction.

10. An image forming apparatus according to claim 9, wherein the second member is a high-molecular polyethylene sheet.

11. An image forming apparatus according to claim 1, wherein the second member is larger than the cutout and completely covers the cutout.

12. An image forming apparatus, comprising:

an image bearing member for bearing a toner image;

a transfer member arranged to face the image bearing member to form a nip portion together with the image bearing member, and adapted to transfer the toner image to a surface of a transfer sheet guided to the nip portion;

a guide member arranged immediately upstream of the nip portion in a sheet conveying direction so as to guide the transfer sheet to the nip portion and to be held in sliding contact with one side of the transfer sheet, wherein the guide member includes:

a first member made of a rigid member, having a flat surface along the sheet conveying direction and having a cutout with a specified width along a sheet width direction normal to the sheet conveying direction formed in the flat surface at a leading end portion located at a downstream side in the sheet conveying direction, and a second member made of an elastic flat member and placed on the flat surface of the first member so as to cover the cutout and to be held in sliding contact with the one side of the transfer sheet, and wherein the second member is larger than the cutout to completely cover the cutout, and the cutout of the first member is located closer to the transfer member than a tangent at the nip portion and a leading end of the second member is located closer to the image bearing member than the tangent.

13. An image forming apparatus according to claim 12, wherein the first member is made of a hard resin or metal having a high shape retaining property.

14. An image forming apparatus according to claim 12, wherein, when a postal card is conveyed as the transfer sheet, the width of the cutout in the sheet width direction is slightly wider than the width of the postal card normal to a conveying direction of the postal card.

15. An image forming apparatus according to claim 12, wherein the second member is made of a conductive material.

16. An image forming apparatus according to claim 12, wherein the second member has an elastic force selected from a range from 0.002 gf/mm$^2$ (inclusive) to 0.02 gf/mm$^2$ (inclusive).

17. An image forming apparatus according to claim 12, wherein the second member is made of an abrasion resistant material.

18. An image forming apparatus according to claim 12, wherein the second member is made of a material having a low coefficient of friction.

19. An image forming apparatus according to claim 12, wherein the second member is made of a material having an abrasion resistance and a low coefficient of friction.

20. An image forming apparatus according to claim 19, wherein the second member is a high-molecular polyethylene sheet.

* * * * *